United States Patent [19]

Garmon

[11] 4,192,444

[45] Mar. 11, 1980

[54] FOUR CELL BOX AND BLANK THEREFOR

[75] Inventor: Ivan E. Garmon, St. Joseph, Mo.

[73] Assignee: Champion International Corporation, Stamford, Conn.

[21] Appl. No.: 947,770

[22] Filed: Oct. 2, 1978

[51] Int. Cl.[2] ..... B65D 5/48

[52] U.S. Cl. ..... 229/28 R

[58] Field of Search ..... 229/28 R

[56] References Cited

U.S. PATENT DOCUMENTS

| | | | |
|---|---|---|---|
| 2,785,844 | 3/1957 | Metzger | 229/28 R |
| 3,006,529 | 10/1961 | Richardson | 229/28 R |
| 3,825,174 | 7/1974 | Booth, Jr. | 229/28 R |
| 3,921,891 | 11/1975 | Gorham | 229/28 R |

*Primary Examiner*—Davis T. Moorhead
*Attorney, Agent, or Firm*—Evelyn M Sommer

[57] ABSTRACT

A single, planar, paperboard blank is disclosed, which when folded, forms a rectangular box construction provided with integral, two ply divider partitions within the interior of the box. The partitions form four individual cells between the side walls of the box for receiving articles.

12 Claims, 9 Drawing Figures

Fig. 1.
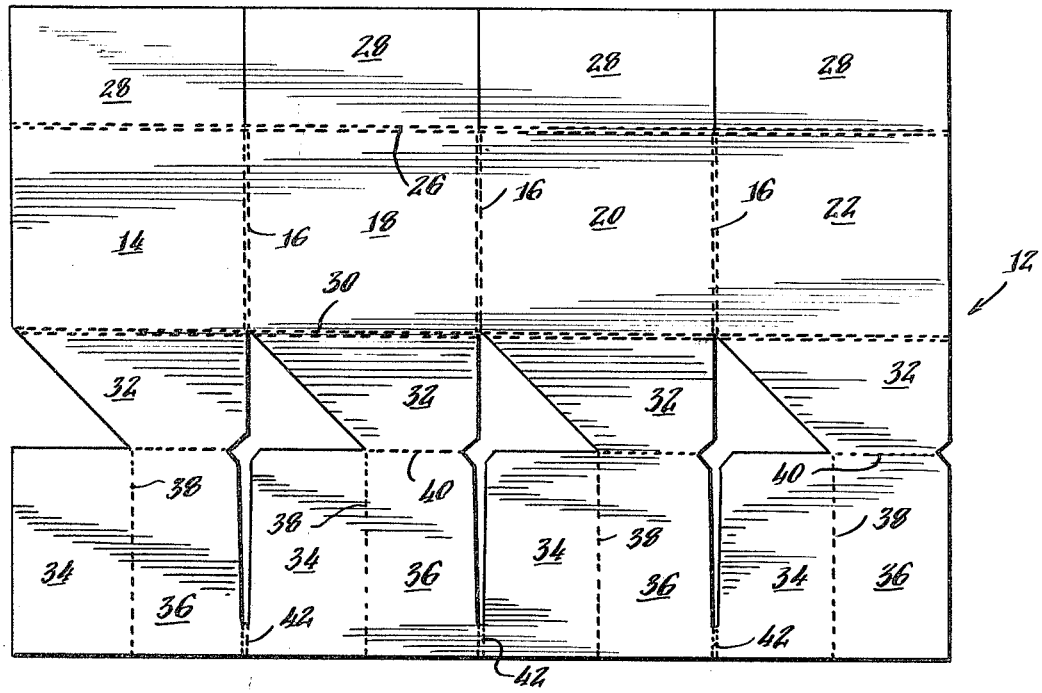
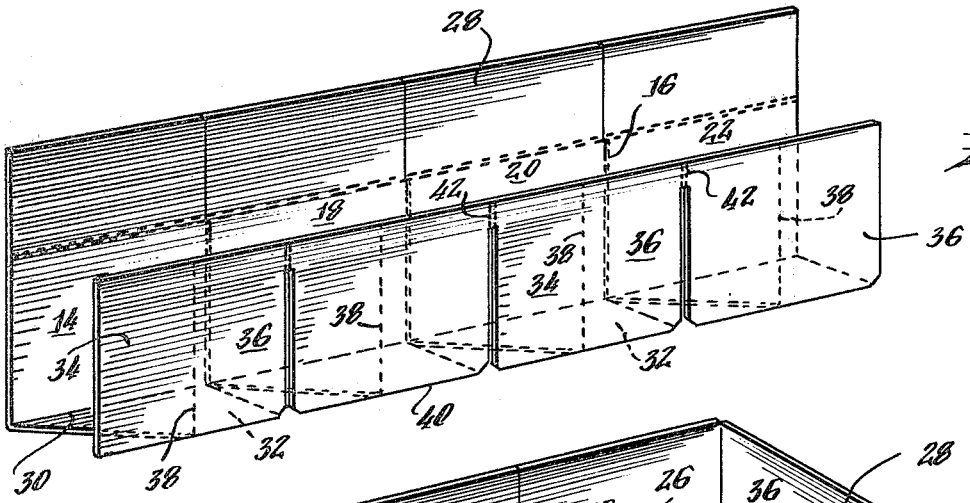
Fig. 2.
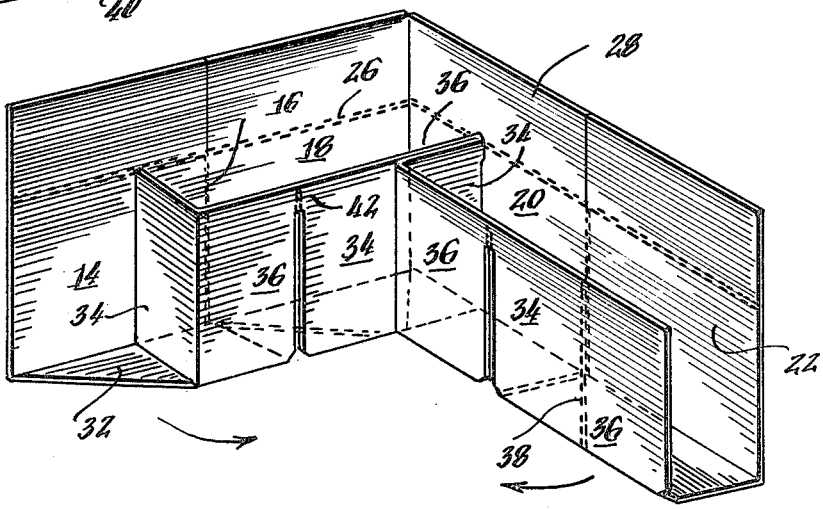
Fig. 3.

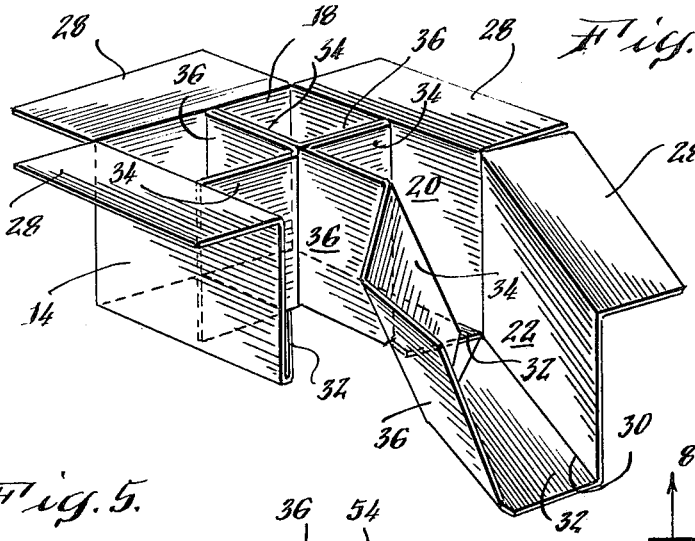
Fig. 4.
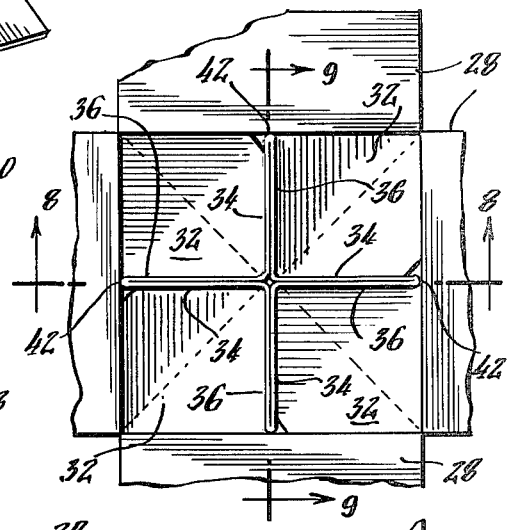
Fig. 6.
Fig. 5.
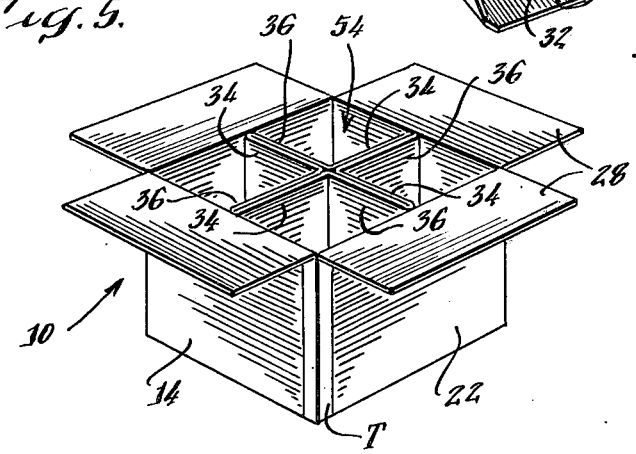
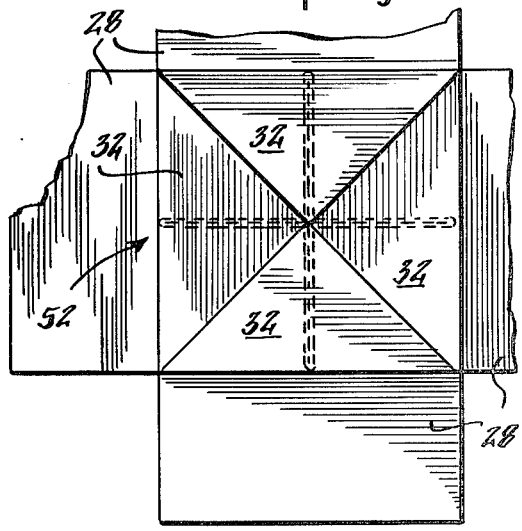
Fig. 7.
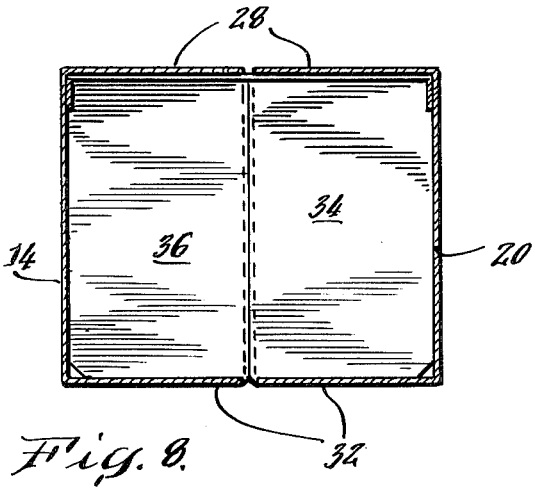
Fig. 8.
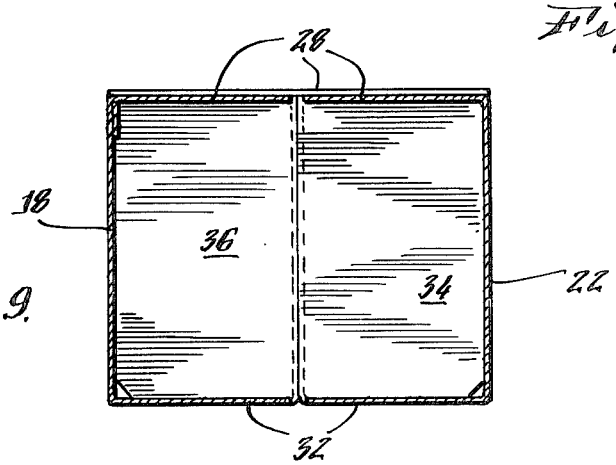
Fig. 9.

FOUR CELL BOX AND BLANK THEREFOR

BACKGROUND OF THE INVENTION

This invention relates to a paperboard box construction, and more particularly, a paperboard box construction provided with integral divider panels for dividing the interior of the box into four equal cells.

Description of the Prior Art:

Corrugated paperboard boxes are used to hold a variety of articles. Where the articles include jars, bottles, cans or other cylindrical-type objects, the box interior is usually divided into a number of cells. Each cell holds one of the articles and is separated from an adjacent cell by a corrugated divider panel to minimize damage to the article occasioned by its contact with an adjacent article. This is of particular importance where the articles are made from glass, such as bottles or jars.

It was common practice, heretofore, to provide a separate, collapsible, multi-cell divider inserted within the box prior to insertion of the articles. The box is fully erected and the multi-cell collapsible divider for forming individual cells within the box is then inserted within the interior of the box. The multi-cell divider is formed from perpendicular interleaved and pivoted panels. The length of each panel within the interior of the box is equal to the width or length of the box, depending upon its orientation.

While the prior art construction precluded adjacent articles from contacting each other, the provision of a separate, multi-cell divider, and a separate box required additional storage space and erection time for the resultant box. The parts would also have to be stored separately until used.

Furthermore, the wall panels of the prior art multi-cell divider were single ply, resulting in low stacking strength of boxes provided with such dividers.

SUMMARY OF THE INVENTION

In accordance with the present invention, a multi-cell divider is formed integral with a planar die cut blank used to produce a corrugated box construction. The blank can be shipped to a user who could erect it on site into a multi-compartmented box in one simple operation. On site storage is also more compact.

The multi-cell divider includes a plurality of pairs of rectangular panels pivotably connected to the bottom closure panels of the box. The bottom closure panels are trapezoidal in shape and are hingedly connected to the bottom edge of the side wall panels of the box. The rectangular panels in each pair are hingedly connected to each other along a vertical score line. Each pair of panels is also hingedly connected to an adjacent pair of like rectangular panels pivotably connected to another one of the trapezoidal bottom flaps. Rectangular top or closure flaps are connected by fold lines to the top edges of each side wall panel.

The box is erected by folding the side wall panels 90° relative to the bottom panels, while pivoting the pairs of rectangular panels in a like manner 90° relative to the bottom panels, until the pairs of rectangular panels and side wall panels are parallel. The panels in each pair of rectangular panels connected to each bottom trapezoidal panel are folded 90° relative to each other about the vertical score lines and one of the rectangular panels in each pair abut in back-to-back relation an adjacent rectangular panel in a panel pair connected to an adjacent trapezoidal bottom panel. The folding action also causes the side wall panels to fold 90° relative to each other, resulting in a rectangular parallelopiped box, provided with double, back-to-back reinforced divider walls forming four cells within the interior of the box. The reinforced or double divider walls enable the box to be stacked without collapsing.

BRIEF DESCRIPTION OF THE DRAWINGS

Further objects and advantages of the invention will become apparent from the following description and claims, and from the accompanying drawings wherein:

FIG. 1 is a plan view of a paperboard blank for forming the box of the present invention;

FIGS. 2 to 4, inclusive, are perspective views illustrating the manner of folding the blank of FIG. 1 to form the box of the present invention;

FIG. 5 is a perspective view of a four-cell box of the present invention formed from the blank of FIG. 1;

FIG. 6 is a top plan view of the box of FIG. 5;

FIG. 7 is a bottom plan view of the box of FIG. 5;

FIG. 8 is a cross-sectional view of the box of FIG. 5 taken substantially along the plane indicated by line 8—8 of FIG. 6; and FIG. 9 is a cross-sectional view of the box of FIG. 5 taken substantially along the plane indicated by line 9—9 of FIG. 6.

DETAILED DESCRIPTION OF THE PREFERRED EMBODIMENT

Referring now to the drawings in detail, wherein like numerals indicate like elements throughout the several views, the four-cell box 10 of the present invention is formed from a single, planar, paperboard blank 12, depicted in FIG. 1.

The blank 12 includes a front, rectangular side wall panel 14 connected by a vertical fold line 16 to a side, rectangular side wall panel 18, which in turn is connected by a vertical fold line 16 to a rear, rectangular side wall panel 20. A second side, rectangular side wall panel 22 is connected by a third vertical fold line 16 to rear, side wall panel 20. As shown in FIG. 1, each of the rectangular panels 14, 18, 20 and 22 are substantially of the same rectangular dimensions.

Connected by the horizontal fold line 26 to the top edge of each of the panels 14, 18, 20 and 22 is a top closure flap 28.

Connected by a double score line 30 to the bottom edge of each of the rectangular panels 14, 18, 20 and 22 is a substantially trapezoidal, bottom panel 32. A pair of rectangular panels 34, 36, hingedly connected to each other along a vertical score line 38, is connected by a fold line 40 to the bottom edge of each trapezoidal bottom panel 32. Specifically, the top edge of the right-hand, rectangular panel 36 of each pair of panels 34, 36 is connected by the fold line 40 to the bottom edge of a trapezoidal panel 32. Each left-hand panel 34 of the pair of panels 34, 36, except for the last or lefthandmost panel 34, is connected by a double score line 42 to the panel 36 in the adjacent pair of rectangular panels 34, 36.

In erecting blank 12 into box 10, the bottom 52 and a four-cell divider structure 54 are formed by causing the trapezoidal panels 32 to be pivoted ninety degrees relative to the front, rear and side, side wall panels 14, 18, 20 and 22. Then, the pairs of rectangular panels 34, 36 are pivoted about fold lines 40 so that they are substantially parallel to the panels 14, 18, 20 and 22 (FIG. 2). Then, the panels 14, 18, 20 and 22 are pivoted relative to each other about vertical score lines 16, as shown in FIGS. 3 and 4. Panels 14 and 22 may be connected along adjacent edges by tape T, staples, or any other conventional joining means.

When the panels 14, 18, 20 and 22 are pivoted relative to each other, a portion of each of the trapezoidal panels 32 are caused to overlie each other (see FIG. 7). The panels 36 pivoted ninety degrees relative to panel 34 in each panel pair 34, 36 about score line 38 and the panels 36 and 34 in adjacent panel pairs are thus caused to be placed in abutment (see FIGS. 3 and 4). By pivoting the panels 34, 36 in each panel pair ninety degrees with respect to each other, the panels 34, 36 in adjacent panel pairs are placed in back-to-back abutment by being pivoted 180 degrees relative to each other about the double score line 42. The abutting rectangular panels 34, 36 in adjacent panel pairs form a four-cell divider structure 54 wherein each of the divider walls are double thick or two ply, with concomitant double strength.

The resultant, erected box 10 has four cells formed from integral, double strength, divider panels which can be used to house articles therebetween within the box 10. Because of the two ply construction of the divider walls, the box 10 exhibits excellent stacking strength.

What is claimed as new is as follows:

1. A paperboard box comprising:

a front wall, a rearwall, and a pair of parallel side walls connecting said rear walls, each of said front, rear and side walls having a bottom forming flap pivotably connected to the bottom edge thereof, each of said bottom flaps being overlapped with an adjacent one thereof, a plurality of divider walls within the interior of said box between said side walls, each divider wall including, at least a pair of rectangular panels, each of said panels extending essentially the entire height of said front wall, said rear wall, and said side walls, and one of said rectangular panels being folded about a hinge line connecting it to a bottom flap within the interior of said box and each panel of each of said pair of rectangular panels being folded relative to the other into planar abutment with one of said panels in an adjacent one of said divider walls to form a plurality of cells within the interior of said box each partially defined by at least two walls, each of said last mentioned walls comprising at least two of said rectangular panels in planar abutment with each other.

2. The box of claim 1 wherein the other rectangular panel in at least some of said pairs of panels is pivotably connected to said one of said rectangular panels in an adjacent pair of rectangular panels.

3. The box of claim 2 wherein each of said bottom flaps is trapezoidal in plan.

4. The box of claim 1 wherein each of said rectangular panels is in abutment with another like panel within the interior of said box to form a two ply divider partition defining in conjunction with said front, rear and side walls said plurality of cells.

5. The box of claim 4 wherein the other rectangular panel in at least some of said pairs of panels is pivotably connected to said one of said rectangular panels in an adjacent pair of rectangular panels.

6. The box of claim 4 wherein each of said front, rear and side walls has a top forming flap pivotably connected to the top edge thereof.

7. A paperboard box comprising:

a front wall, a rear wall, and a pair of parallel side walls connecting said front and rear walls, and a plurality of panels forming divider partitions within the interior of said box, each of said panels being connected by a fold line to a bottom panel of said box extending substantially perpendicular to said front, rear and side walls, and said bottom panels being connected by a fold line to one of said front, rear and side walls.

8. The box of claim 7 wherein each of said panels is formed from two plies of paperboard material.

9. The box of claim 8 wherein each of said panel plies is connected by a fold line to a bottom panel of said box.

10. A blank for forming a four cell box comprising:

a planar sheet divided into four rectangular panels connected together along vertical score lines, a trapezoidal panel hingedly connected to a bottom edge of each of said rectangular panels, and a pair of rectangular panels of like dimension pivotably connected to each other along a vertical score line, one panel in each pair of panels being connected along a horizontal score line to the bottom edge of each trapezoidal panel, selected adjacent ones of said rectangular panels in each pair thereof being hingedly connected to each other.

11. The blank of claim 10 wherein said first four rectangular panels are of like dimensions.

12. The blank of claim 11 including a rectangular panel of like dimension hingedly connected to the top edge of each of said first four rectangular panels.

* * * * *